United States Patent [19]

Jones

[11] Patent Number: 4,517,912

[45] Date of Patent: May 21, 1985

[54] HYDROFOIL CONTROL

[76] Inventor: Clyde B. Jones, 3531 Alginet Dr., Encino, Calif. 91436

[21] Appl. No.: 408,710

[22] Filed: Aug. 16, 1982

[51] Int. Cl.[3] ..... B63B 1/18

[52] U.S. Cl. ..... 114/275

[58] Field of Search ..... 114/274, 275, 276, 280, 114/281, 282, 61, 283

[56] References Cited

U.S. PATENT DOCUMENTS

| | | | |
|---|---|---|---|
| Re. 28,615 | 11/1975 | Keiper | 114/282 |
| 1,186,816 | 6/1916 | Meacham | 114/281 |
| 2,387,907 | 10/1943 | Hook | 114/66.5 |
| 2,603,179 | 7/1949 | Gardiner | 114/66.5 |
| 2,773,467 | 12/1956 | Bailey | 114/280 |
| 2,795,202 | 8/1957 | Hook | 114/66.5 |
| 2,856,877 | 10/1958 | Baker | 114/282 |
| 2,856,879 | 10/1958 | Baker | 114/275 |
| 3,104,642 | 9/1963 | Piazza | 114/280 |
| 3,141,437 | 7/1964 | Bush et al. | 114/276 |
| 3,286,673 | 11/1966 | Nason | 114/282 |
| 3,465,704 | 9/1969 | Baker | 114/276 |
| 3,747,549 | 6/1972 | Shutt | 144/39 |
| 3,762,353 | 9/1971 | Shutt | 114/39 |
| 3,797,434 | 3/1974 | Matthews | 114/66.6 H |
| 3,929,084 | 12/1975 | Cline | 114/66.5 H |
| 4,027,614 | 6/1977 | Jones | 114/163 |

*Primary Examiner*—Trygve M. Blix
*Assistant Examiner*—Jesùs D. Sotelo

[57] ABSTRACT

Apparatus for dynamic support and height control of a boat equipped for power or wind propulsion and adapted to be supported above the water by hydrofoils, including a control hydrofoil and a main hydrofoil pivotally mounted on the boat, the apparatus being constructed and arranged to enable the control hydrofoil to regulate the main hydrofoil's angle of attack. The innovation being that the control hydrofoil is structurally placed in a completely submerged position where it utilizes its load variation dependency upon depth of submergence to automatically seek and maintain the boat at a predetermined height range above the water surface.

13 Claims, 12 Drawing Figures

HYDROFOIL CONTROL

BACKGROUND OF THE INVENTION

This invention pertains to the field of control of hydrofoils on boats equipped with power or wind propulsion.

Automatic mechanical control of operational height above the water surface is a definite requirement for sailing hydrofoils where electronic or power equipment devices are either impractical, too complex, or not allowed. Attempts to satisfy this requirement have been directed toward sensing the water surface by floats, planing devices, drag surfaces, and V type control foils. All of these devices penetrate the water surface and depend on the load variations caused by changes in flotation volume or changes in wetted impact area of the device. All are prone to throwing spray which causes additional drag and discomfort to the crew. The floats, planers and drag devices are inherently inefficient and experience difficulties when the water surface is choppy. The V type foils are efficient in calm water but when it is choppy they are subject to intrusion of air into the low pressure area of the hydrofoil causing loss of lift, erratic control and low efficiency—this phenomena is called ventilation. The lack of an efficient height control system, free of ventilation problems may be the reason why sailing hydrofoils have not realized their full performance or commercial potential.

SUMMARY OF THE INVENTION

The present invention embodies a control hydrofoil which regulates the angle of attack of a main hydrofoil mounted on structure pivotally attached to a boat adapted to be supported above the water by hydrofoils. The control hydrofoil is located in a completely submerged and ventilation free position nearer to the water surface than the main hydrofoil. Normally, the lifting force moments generated by the control and main hydrofoils about the pivot are balanced and the hydrofoils remain in a stabilized position. If the boat is forced to move from the equilibrium position causing a change in depth of the hydrofoils, the control hydrofoil being nearer to the surface than the main hydrofoil, experiences larger percentage change in lifting load due to the water surface effect. This unbalances the moments, thereby forcing the main hydrofoil to change angle of attack which results in new hydrofoil loads necessary to correct the boat motion. This action enables the control hydrofoil to seek and maintain a completely submerged position while the boat is sustained at a predetermined height range above the water surface.

The objectives of increasing efficiency, reducing spray and alleviating ventilation problems are realized in this invention by the structural arrangement enabling the operation of the control hydrofoil in a completely submerged position. The superior efficiency of hydrofoils over surface riding devices in the speed range proposed for this device is well documented in technical literature. Spray and ventilation reduction have been observed during operation of a prototype hydrofoil sailboat equipped with a device as described in this document. Other advantages of this invention are presented in the detailed description section.

DESCRIPTION OF THE SHOWN EMBODIMENTS

Definitions

Angle of Attack is the angle between the chord plane and a line passing thru the trailing edge of a hydrofoil, the line defining the direction of motion of the hydrofoil relative to the water, the angle being positive when the line is below the chord plane. See Flow Direction.

Angle of Incidence is the difference between the angles of attack of the main hydrofoil and the control hydrofoil, being positive when the control hydrofoil angle of attack is greater.

Angle of Zero Lift is the angular difference between zero angle of attack and an angle of attack equivalent to zero lift.

Aspect Ratio of a hydrofoil is the span divided by the chord or the span squared divided by the area if the planform is not rectangular.

Cambered Hydrofoil section is one in which the upper surface has more curvature than the lower surface.

Center of Pressure is the point on a hydrofoil at which one load vector can be applied representing the sumnation of all pressures imposed on the hydrofoil by water flow over the hydrofoil.

Chord is the distance between the leading edge and the trailing edge of a hydrofoil in the chord plane.

Chord Plane is a plane defined by three points, two of which are on the trailing edge of a hydrofoil and the third on the leading edge.

Dihedral Angle 5 is the angle between a horizontal reference line such as cross beam 2 and the chord plane of the main hydrofoil 4.

Hydrofoil is defined as an airfoillike structure adapted to exert lifting loads when moving thru a body of water.

Hydrofoil Composite is the combination of structure including the control hydrofoil, the main hydrofoil and the spring mechanism if a spring is used.

Leading Edge is the foremost edge of a hydrofoil.

Load Vector is a line representing the magnitude and direction of the total force created by the summation of all pressures imposed on a hydrofoil.

Span is the dimension of a hydrofoil perpendicular to the motion of the hydrofoil thru the water.

Symmetrical Hydrofoil section is one in which the upper and lower surfaces have identical curvature and offsets from the chord plane.

Tips are the outboard extremities of the span of a hydrofoil.

Trailing Edge is the aftmost edge of a hydrofoil.

Flow Direction is the path a water particle makes relative to a hydrofoil chord plane, said water particle being at a distance from the hydrofoil such as to be undisturbed by the motion of the hydrofoil. The relative motion and angle is determined vectorially. See Angle of Attack. The flow direction is the reference line for hydrofoil angle of attack on which foil section characteristics are based.

Figure 1:
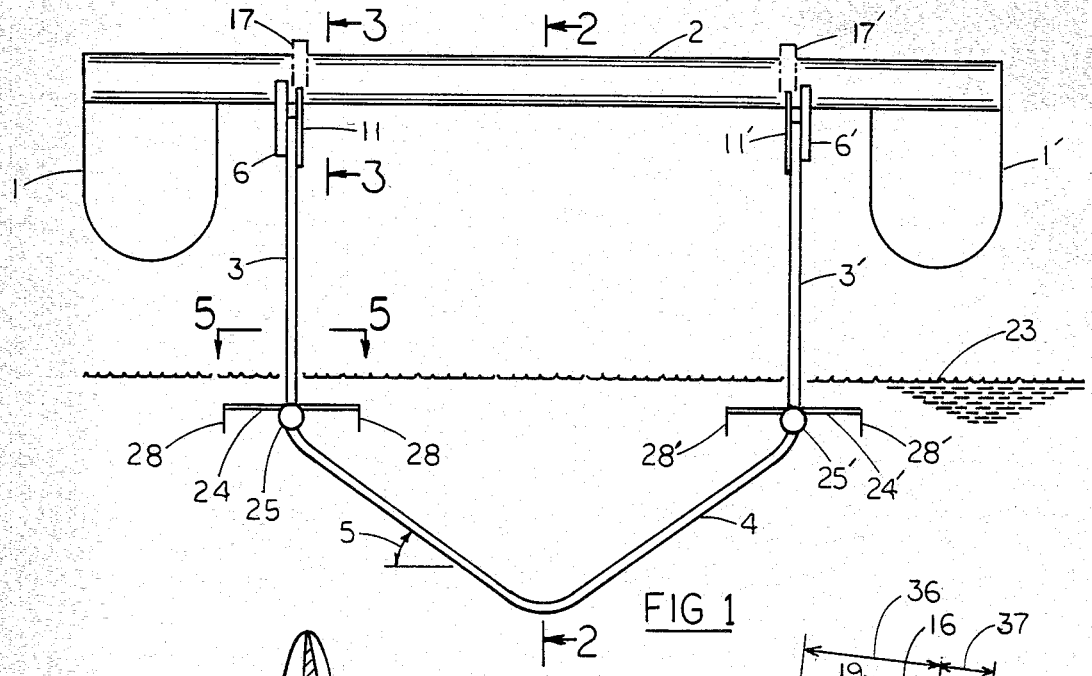
FIG. 1 is a front elevation showing the double strut version of the present invention.
Figure 2:
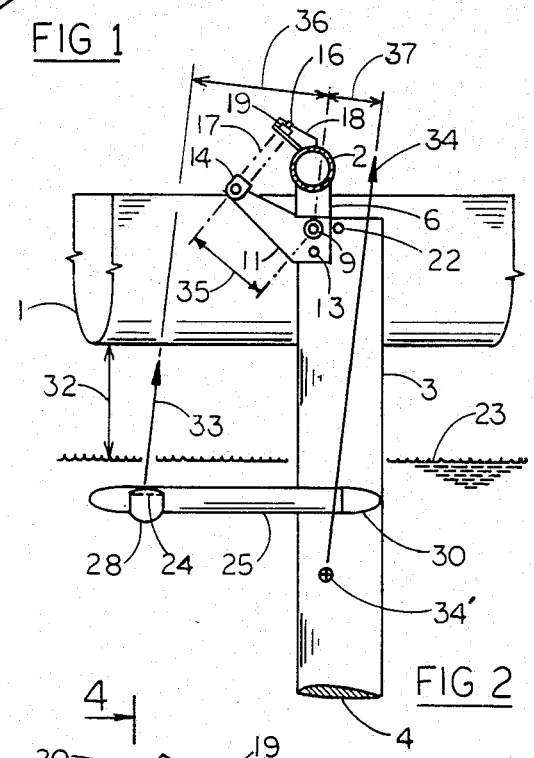
FIG. 2 is a side elevation sectional view of FIG. 1.
Figure 6:
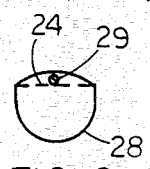
FIG. 6 is a side elevation of FIG. 5 showing the end plates.

Referring to the drawings, FIGS. 1 and 2 illustrate catamaran hulls 1 and 1' interconnected by a cross beam 2, Struts 3 and 3' are the extensions of the main hydrofoil 4, being bent up from an aluminum extrusion of airfoil shape. The foil attachment means consists of a continuity of structure between the main hydrofoil 4 and the struts 3 and 3'. The main hydrofoil 4 is formed with a dihedral angle 5 between 0 and 60 degrees, preferably 35 degrees.

Figure 4:
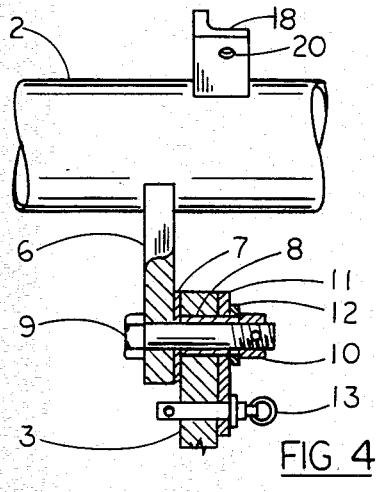
FIG. 4 is a cross sectional view showing additional detail of FIG. 3.
Figure 3:
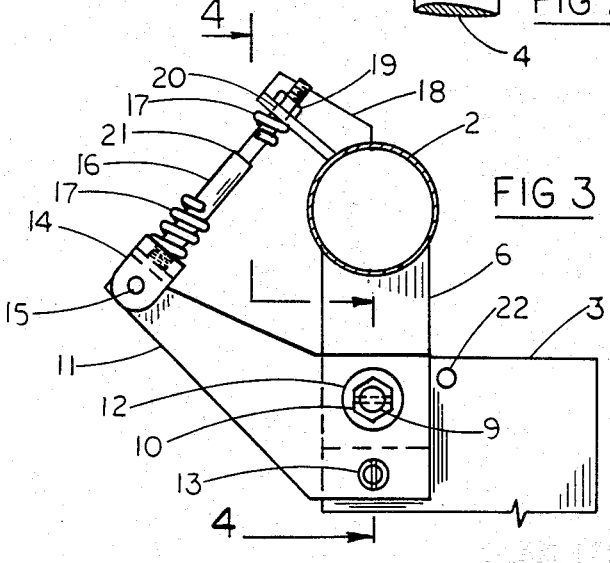
FIG. 3 is a cross sectional view of FIG. 1 hull attachment means including pivotal mount of the struts, spring, stops and adjusting means.

Struts 3 and 3' are attached to cross beam 2 by hull attachment means illustrated in FIGS. 3 and 4. The illustrations are for the right strut 3 and parts for mounting strut 3' are identical but arranged in mirror image on the left side. Strut 3 is mounted inboard of bracket 6 which is welded to cross beam 2. Thrust washer 7 and bushing 8 are clamped by pivot bolt 9 and slotted nut 10 to bracket 6 with strut 3, lever 11 and inboard thrust washer 12 riding on bushing 8 between thrust washer 7 and slotted nut 10. Clearances are provided to give strut 3, lever 11 and inboard thrust washer 12 freedom of rotation about bushing 8. When strut 3 is in the position shown, quick release pin 13 is engaged, locking strut 3 and lever 11 together to rotate about bushing 8. Clevis 14 is straddle mounted on lever 11 and retained by pin 15. Rod 16 is threaded into clevis 14 at one end and the other end of rod 16 passes through spring 17, hole 20 in bracket 18 and is retained by nut 19. Bracket 18 is welded to cross member 2. Rod 16 has a shoulder diameter larger than hole 20 forming stop 21 for passage of rod 16 into hole 20 when spring 17 is compressed. Nut 19 is the adjustable stop for passage of rod 16 out of hole 20. When quick release pin 13 is pulled, the main hydrofoil and all associated parts may be rotated forward until hole 22 can be engaged by quick release pin 13 thereby holding main hydrofoil 4 and associated parts in a retracted position for beaching and transportation purposes.

Figure 5:
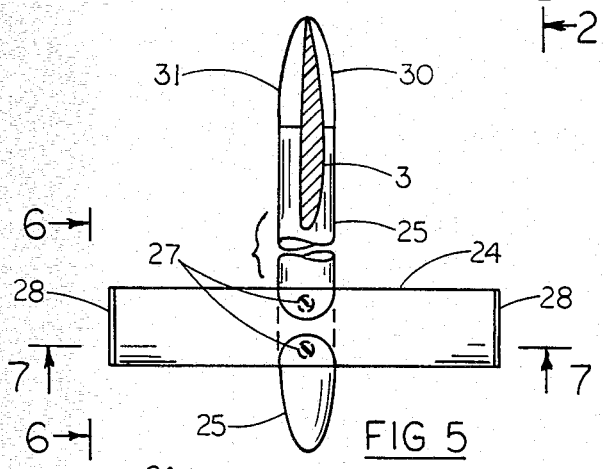
FIG. 5 is a cross sectional view of FIG. 1 showing a plan view of the control hydrofoil on the structural support.
Figure 7:
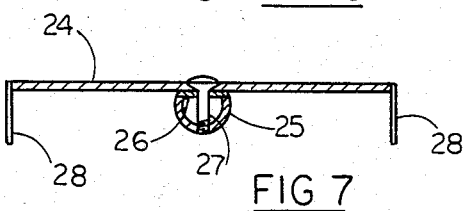
FIG. 7 is a cross sectional view of FIG. 5 showing mounting detail of the control hydrofoil on the structural support.

Control hydrofoil 24 shown in FIGS. 5 and 7 is made of aluminum with an asymmetrical airfoil shape. It is mounted on a connecting means consisting of a structural support 25 made from an aluminum tube. The mounting surface consists of a shim 26 seated in a cutout of structural support 25 so the mounting surface under shim 26 is parallel to the axis of structural support 25. Shim 26 is of sufficient thickness to permit grinding to change the fore and aft angle of the seat relative to the axis of structural support 25 by at least $\pm 2°$. The control hydrofoil 24 is retained by two screws 27 tapped into the bottom side of structural support 25. Once shim 26 is adjusted to the proper angle of incidence, it is bonded to structural support 25. The forward end of structural support 25 is cut and closed to achieve a streamlined shape. The end plate 28 follows the upper surface contour of control hydrofoil 24 and extends downward a distance equivalent to one chord of the control hydrofoil 24. End plate 28 is fastened to control hydrofoil 24 at each tip by screw 29 plus bonding. The aft portion of structural support 25 is cut out to slip over strut 3 and is welded. The blunt aft end of structural support 25 is streamlined with plastic fairings 30 and 31. The structural support 25 is located on strut 3 at a vertical position so that control hydrofoil 24 is approximately ½ chord length below the water surface 23 when hull 1 is supported above the water surface 23 at a predetermined height 32 and the struts 3 and 3' are vertical.

In operation, the moments generated by control hydrofoil 24 about pivot bolt 9 axis must balance moments generated by main hydrofoil 4 and spring 17 about pivot bolt 9 axis for a steady state condition. Such a control hydrofoil 24 load will be referred to as a moment balancing load. A moment balancing load can be achieved without spring 17 but spring 17 serves the purpose of forcing the hydrofoil composite to a lower angle of attack for sailing in flotation and provides a moment gradient about pivot bolt 9 opposing undesirable increases in the hydrofoil composite angle of attack when flying on the foils. Therefore, inclusion of spring 17 is the preferred arrangement.

Spring 17 and rod 16 with stop 21 and stop nut 19 are used to adjust spring load. This is useful in trimming the depth of operation of control hydrofoil 24 by screwing rod 16 in or out of clevis 14. Stops can be adjusted by combination of use of threaded connections at both ends of rod 16.

FIG. 2 illustrates control hydrofoil 24 load vector 33 and main hydrofoil 4 load vector 34 acting in relation to pivot bolt 9 axis. Spring 17 is acting at moment arm 35. When main hydrofoil 4 rotates forward, the moment arms 35 and 36 change relatively small in percentage, while the main hydrofoil 4 moment arm 37 can change radically or reverse direction. It should be understood that the aforementioned radical percentage changes in moment arm 37 length occur as a result of variations in direction of flow over main hydrofoil 4 whether the flow direction changes are caused by vertical or pitch motion of the boat relative to the water surface, by local conditions under the surface such as in a wave, or by rotation of the hydrofoil composite. It is a fundamental characteristic of any hydrofoil such as main hydrofoil 4 to generate a total load represented by load vector 34 which has a predictable angular relationship to flow direction over the main hydrofoil 4 and a predictable point of application, center of pressure 34', of the load vector 34 on main hydrofoil 4. This fundamental characteristic includes load vector 34 moving with changes in flow direction. Therefore, the main hydrofoil load vector 34 rotates about a translating center of pressure 34' in unison with changes of flow direction resulting in variances of magnitude of load vector 34 and moment arm 37 length. For example, a downward motion of the hull at pivot bolt 9 will cause an upflow over main hydrofoil 4 thereby increasing the magnitude of load vector 34. The center of pressure 34' moves forward shortening the moment arm 37, a fundamental characteristic of cambered hydrofoil sections. Load vector 34 rotates about center of pressure 34' toward pivot bolt 9 causing additional shortening of moment arm 37. With pivot bolt 9 properly located relative to main hydrofoil 4, moment arm 37 length will decrease percentagewise more than the magnitude of load vector 34 increases percentagewise causing main hydrofoil 4 moment about pivot bolt 9 to decrease. Consequently, the moments about pivot bolt 9 are unbalanced in a direction to cause an increase in angle of attack of the hydrofoil composite. Control hydrofoil 24 also experiences an increase of flow angle causing a further increase of angle of attack of the hydrofoil composite. The foregoing illustrates the mutually cooperative effort of the main and control hydrofoils resulting in a forceful opposition to vertical motions of the boat. This unique situation in which stabilized moments of the control and main hydrofoils oppose each other but dynamic moments, ie., changes in moments from the stabilized condition, are supportive of each other is achieved as illustrated in FIG. 2 where pivot bolt 9 is located approximately vertically above the main hydrofoil 4 so that moment arm 37 is less than one main hydrofoil 4 chord length when the hydrofoil composite is in a stabilized normal operating position.

It should be noted that the above described opposition to vertical motion is reversed for an upward motion of the hull at pivot bolt 9 so that the hydrofoil composite's response opposes the motion by a decrease in angle of attack. In waves or in recovery from an errant upward vertical motion of the hull, the control hydrofoil 24 may broach the water surface 23 leaving only spring 17 to force the hydrofoil composite to rotate to a lower angle of attack if hull and hydrofoil angular relationships are severe enough to cause load vector 34 to pass forward of pivot bolt 9. Under these circumstances, the moment of the spring rate of spring 17 must exceed the mathematical differential of load vector 34 moment about pivot bolt 9 in respect to spring motion.

In order to establish the range of pivot bolt 9 horizontal location that satisfies individual design requirements, an equation representing the moment of load vector 34 about pivot bolt 9 should be differentiated in respect to angle of attack of the main hydrofoil 4 and solved for the location of pivot bolt 9 with the differential equation set equal to zero. This gives the most forward position for pivot 9. A position aft of the most forward position of pivot bolt 9 will produce a decrease in moment with increase in angle of attack. The maximum aft position of pivot bolt 9 is where load vector 34 passes through pivot bolt 9 when the hydrofoil composite is in normal flight position. A computerized dynamic analysis of the complete prototype boat system and tests of the prototype indicate that the optimum position for pivot bolt 9 is in a range of plus or minus $\frac{1}{8}$ chord of half way between the most forward and aft positions as established by the above procedure.

In operation, the function of control hydrofoil 24 is to regulate the angle of attack and lift load of main hydrofoil 4. The moment balancing load capability of control hydrofoil 24 is influenced by the depth of submergence below water surface 23. The moment balancing load capability increases rapidly to 60% at a depth of $\frac{1}{2}$ control hydrofoil's 24 chord, increases progressively slower to 75% at a depth of 1 chord and finally approaches asymptotically to 100% of full load capacity at 2 to 3 chords depth. At a very shallow depth the upper surface flow of control hydrofoil 24 separates and the lift load capability is limited to that generated by hydroplaning alone. When a cavity forms on a hydrofoil surface from either cavitation or ventilation, the flow over the cavity is not in contact with the hydrofoil surface and such flow is described as separated.

A hydrofoil operating submerged can exceed a speed where the pressures over the top of the hydrofoil become less than the vapor pressure of the water causing a vapor filled cavity to be formed with detrimental effects upon the lift and drag. This is called cavitation and occurs mostly beyond the normal speed range of sailing hydrofoils. At shallow depth, if any portion of the hydrofoil penetrates the surface, air can find a path for intrusion into the low pressure area on the upper surface of the hydrofoil thereby forming an air filled cavity. This is ventilation and can occur at normal operating speeds. Ventilation can also be caused by air finding an access path thru the core of a vortex formed at the tip of the hydrofoil and trailing up to the water surface 23 where the air enters. This latter problem is prevented by the end plates 28 which inhibit the forming of an open core in the vortex. Ventilation from surface penetration is prevented by structurally assuring a submerged position of the control hydrofoil 24 and the prevention of hydroplaning loads which will cause the control hydrofoil to rise to the surface. End plates 28 also increase the effective aspect ratio of control hydrofoil 24 thereby increasing efficiency.

In operation, the control hydrofoil 24 normally is submerged at a depth of about $\frac{1}{2}$ chord when the sailboat is trimmed in a stable condition, If an outside influence such as a wind gust forces the bow down increasing the depth of submergence of control hydrofoil 24, the load vector 33 on control hydrofoil 24 increases and rotates the main hydrofoil 4 forward. The angle of attack of the main hydrofoil 4 increases causing an increase in load vector 34 and an upward corrective motion of the boat.

A bow up disturbance of the boat causes the control hydrofoil 24 to rise toward the water surface 23. If the disturbance is sufficiently forceful, the control hydrofoil 24 may break thru the water surface 23 and attempt to hydroplane. Hydroplaning is objectionable because of reduced efficiency and the throwing of spray.

Hydroplaning is defined here as the generation of lift loads on a hydrofoil by dynamic impact of the water on the bottom surface of the hydrofoil while the upper surface flow is separated contributing little if any to the lift loads. This can occur when the hydrofoil is skimming along the water surface 23 or when the hydrofoil is submerged and the flow over the upper hydrofoil surface is separated. When submerged and flow attached on the upper surface, a hydrofoil can generate a lift load many times the lift load of a hydroplaning hydrofoil.

Hydroplaning is prevented by structurally building in an angle of incidence of control hydrofoil 24 which for a given size and airfoil characteristics renders the control hydrofoil 24 incapable of sustaining moment balancing loads by hydroplaning alone. The same angle of incidence in combination with a substantial angle of zero lift and aspect ratio enables the control hydrofoil 24 to generate moment balancing loads when it is submerged and the upper surface flow is attached.

Should the control hydrofoil 24 in choppy conditions try to operate above the chop through, the flow on control hydrofoil's 24 upper surface separates causing control hydrofoil 24 to dive. Since the separated cavity tends to hang on to control hydrofoil 24 for a short period, control hydrofoil 24 cannot maintain a position above the chop trough even while going thru the chop crest. Instead, control hydrofoil 24 seeks a position of minimum load capability at a shallow submergence below the chop trough thereby enabling the control hydrofoil 24 to average the load experienced while traversing under the chop crest to the required moment balancing load.

In operation when heeling, the control hydrofoils 24 and 24' have unequal depth of submergence. However, if the heel angle is large enough, the windward control hydrofoil can operate above the water surface providing that the lee control hydrofoil can generate enough moment about pivot bolt 9 to balance the spring and main hydrofoil moments. If the lee control hydrofoil cannot balance moments, then the hydrofoil composite will reduce angle of attack and recover at a lower hull height above the water surface where the hydrofoil composite will stabilize with both control hydrofoils submerged.

Figure 8:
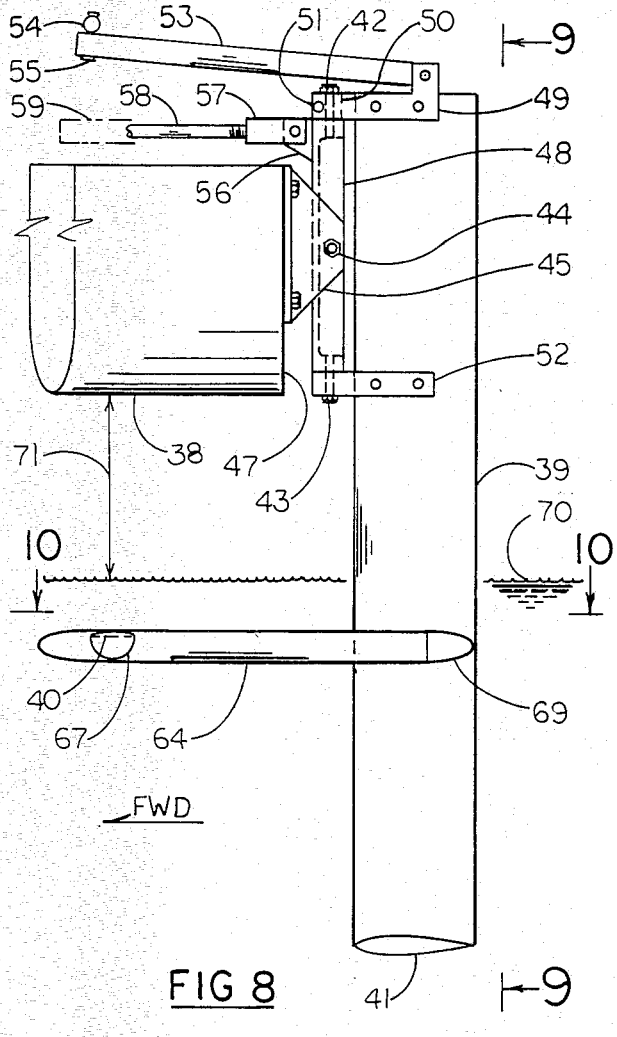
FIG. 8 is a side elevation showing a single strut version of the present invention.
Figure 9:
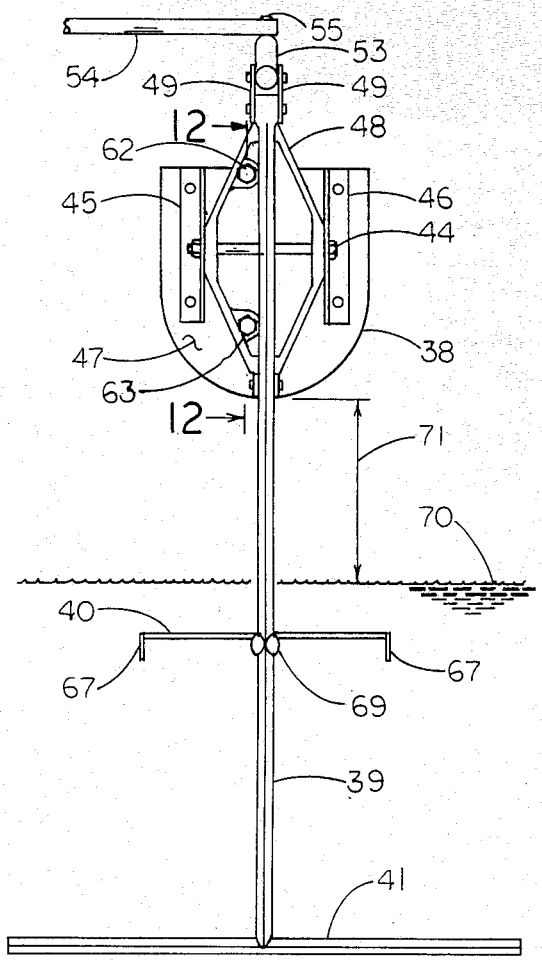
FIG. 9 is an elevation looking forward at FIG. 8 and showing additional detail of FIG. 8.

Referring to the drawings, FIGS. 8 and 9 illustrate a catamaran hull 38 equipped with a strut 39, control hydrofoil 40 and main hydrofoil 41 such that the last three parts mentioned may collectively rotate about vertical hinge bolts 42 and 43 and beamwise horizontal pivot bolt 44. This identical arrangement is installed on both hulls but only the right hull 38 is shown. This arrangement adapts strut 39 to be used as a rudder.

Brackets 45 and 46 are bolted to transom 47 providing support of pivot bolt 44 which pivotably mounts gimbal 48 between brackets 45 and 46. The upper hinge fitting 49 is made up of flat plate, one being bolted on each side of strut 39. Cubical block 50 is clamped lightly by bolt 51 between the two fittings 49 so that fittings 49 are free to rotate about bolt 51. Block 50 is retained in contact with gimbal 48 by hinge bolt 42 which is screwed into gimbal 48 leaving block 50 free to rotate about hinge bolt 42. Lower hinge fitting 52 is machined to fit around strut 39 to which lower hinge fitting 52 is bolted. Lower hinge bolt 43 is screwed into gimbal 48 through lower hinge fitting 52 leaving lower hinge fitting 52 free to rotate about lower hinge bolt 43. By removing lower hinge bolt 43, the whole rudder and hydrofoil assembly is free to retract by rotating aft about bolt 51 for transportation and beaching purposes.

The upper hinge fitting 49 provides mounting for tiller 53. Tiller 53 is interconnected with the left rudder tiller by cross tube 54 which is pivotably mounted on tiller 53 by pin 55.

Gimbal 48 provides a lug 56 to which clevis 57 is pivotably attached. Connecting rod 58, screwed into clevis 57, is interconnected with its counterpart on the left hull by linkage 59 so that the motion of the right strut 39 about horizontal pivot bolt 44 produces the opposite direction of motion by the left strut about its horizontal pivot axis. This arrangement is illustrated and described in U.S. Pat. No. 4,027,614.

Figure 12:
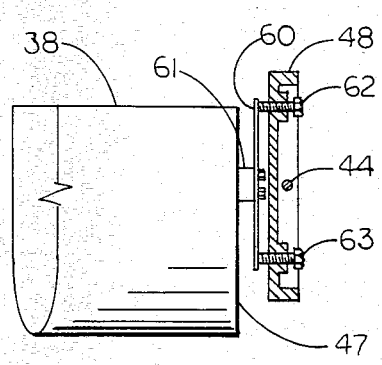
FIG. 12 is a cross sectional view of FIG. 9 showing the spring and spring adjustment means.

Spring 60 shown in FIG. 12 is rigidly mounted on transom 47 on block 61. Spring 60 provides forces tending to position strut 39 about pivot bolt 44 by adjustment of bolts 62 and 63 screwed into gimbal 48. Strut 39 travel about pivot bolt 44 is limited by transom 47, thereby providing stops.

Figure 10:
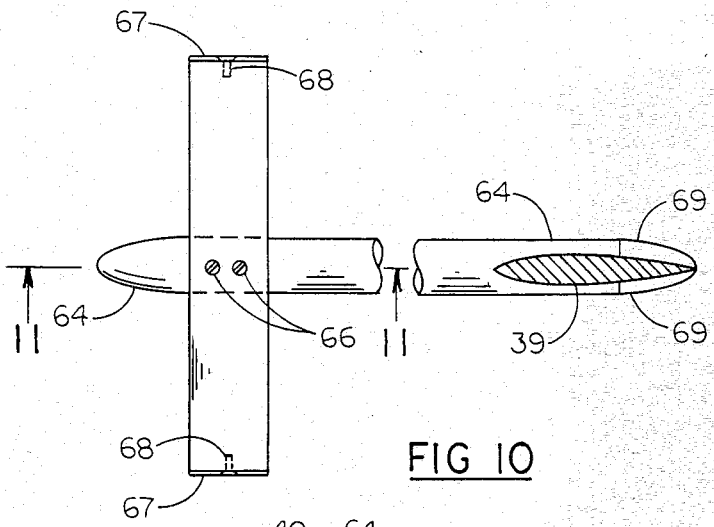
FIG. 10 is a sectional plan view of FIG. 8 showing the control hydrofoil and structural support.
Figure 11:
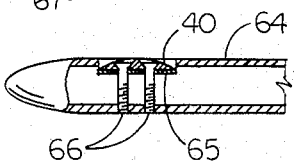
FIG. 11 is a cross sectional view of mounting detail of the control hydrofoil.

Foil attachment means consists of main hydrofoil 41 being welded to the lower end of strut 39. Control hydrofoil 40, FIGS. 10 and 11, is mounted on structural support 64. The mounting surface consists of a shim 65 seated in a cutout of structural support 64 so that the mounting surface under shim 65 is parallel to the axis of structural support 64. Shim 65 is of sufficient thickness to permit grinding to change the fore and aft angle of the seat relative to the axis of structural support 64 by at least $\pm 4°$. The control hydrofoil 40 is retained by two screws 66 tapped into the bottom side of structural support 64. Once shim 65 is adjusted to the proper angle of incidence, it is bonded to structural support 64. The forward end of structural support 64 is cut and closed to achieve a streamlined shape. The end plate 67 follows the upper surface contour of control hydrofoil 40 and extends downward a distance equivalent to one chord of the control hydrofoil 40. An end plate 67 is fastened to control hydrofoil 40 at each tip by a screw 68 plus bonding. The aft portion of structural support 64 is cut out to slip over strut 39 and is welded. The blunt aft end of structural support 64 is streamlined by plastic fairings 69. The structural support 64 is located on strut 39 at a vertical position so that control hydrofoil 40 is approximately $\frac{1}{2}$ chord length below the water surface 70 when the hull 38 is supported above the water surface 70 at a predetermined height 71 and the strut 39 is vertical.

The basic system of FIG. 8 does not include rudder capability or interconnection by linkage 59. Such an arrangement requires a rigid attachment of strut 39 to gimbal 48 by welding upper and lower hinge fittings 49 and 52 to gimbal 48. This arrangement renders the basic system free to independently regulate the height 71 of hull 38 at the location of the unit on hull 38.

The principle of operation of configuration of FIG. 8 is the same as for the configuration of FIG. 1. Both species are limited to controlling the height only at that part of the hull to which they are attached. The configuration FIG. 1 is more efficient than configuration FIG. 8, particularly when subjected to side loads in addition to vertical loads, but is not adaptable in a practical sense for use as a rudder or as an antiheel device. Because of these limitations, the two species are advantageously used in combination as components of a complete system where they cooperatively extend their capability of regulation of height of a portion of the hull to a fully automatic control of a boat in pitch, heel and height above the water surface.

A complete boat system comprising a pair of units of configuration FIG. 8 spaced apart in a beam direction at the stern and configuration FIG. 1 located forward of the boat center of gravity is particularly suited for a sailboat. In this arrangement configuration FIG. 1 provides the major portion of lifting load to support the boat and also provides control of height near the boat center of gravity but has only a minor effect on heeling stability. Configuration FIG. 8 provides loads to stabilize the boat in pitch, heel and direction and also regulates the height of the stern, but has little effect on the lifting loads and the height of the boat near the center of gravity. Obviously, configurations FIG. 1 and FIG. 8 must operate cooperatively for successful operation of the complete system.

The interconnection by linkage 59 of the units of configuration FIG. 8 in the described complete boat system interlocks each configuration FIG. 8 unit such that the control hydrofoils are capable of controlling the main hydrofoils in opposite directions only which provides control of boat heel. The stern height is controlled by the configuration FIG. 8 hydrofoils as they trail behind configuration FIG. 1 hydrofoils. The boat will assume an attitude and stern height as determined by the average angle of attack of the configuration FIG. 8 hydrofoils which must generate an up or down resultant load to stabilize the boat in pitch attitude. The average angle of attack is adjustable by screwing connecting rod 58 in or out of clevis 57. This trim adjustment needs little attention since the boat will automatically assume an attitude that stabilizes pitch and considerable range of pitch attitude is permissible. The interconnection linkage 59 enables the stern mounted configuration FIG. 8 hydrofoils to control heel without effecting the pitch attitude. The interconnection linkage 59 also enables the control hydrofoil 40 on the downwind side to control both left and right main hydrofoils 41 even though the heel angle is enough to cause the windward control hydrofoil 40 to lift completely above the water surface 70.

I claim:

1. In a boat having a hull and propulsive means, said hull adated to be supported on a body of water by flotation and supported dynamically above said body of water by hydrofoils, said hull including apparatus for dynamic support and control of the height of said hull above said body of water, said apparatus comprising:

(a) a main hydrofoil having a chord plane, an angle of attack, a leading edge, a trailing edge and a load vector, (b) a strut means adapted to structurally support said main hydrofoil, (c) a hull attachment means for attaching said strut means to said hull, (d) a foil attachment means for attaching said main hydrofoil to said strut means, said strut means projecting from said hull attachment means and placing said main hydrofoil in a submerged position within said body of water, (e) a pivot means, associated with said strut means and said main hydrofoil, being constructed and arranged to provide freedom of motion of at least a portion of said main hydrofoil relative to said hull such that said freedom of motion results in a change in said main hydrofoil's angle of attack, (f) a control hydrofoil associated with said main hydrofoil by connecting means, said connecting means being constructed and arranged such that when said hull is dynamically supported above said body of water, vertical displacement of the control hydrofoil relative to said hull provides regulation of at least a portion of said main hydrofoil resulting in said chord plane assuming various angles of attack such that displacement of said control hydrofoil toward the hull causes an increase in angle of attack of said main hydrofoil, (g) the improvement comprising: said pivot means being constructed and arranged at a position aft of said control hydrofoil, at least one main hydrofoil chord length above said main hydrofoil and such that the extension of said load vector passes aft of and within one said main hydrofoil chord length of said pivot means axis when said main hydrofoil is in operating position, whereby a decreasing moment of said load vector about said pivot means axis may be attained with an increasing said angle of attack of said main hydrofoil, (h) whereby said control hydrofoil, in cooperation with the main hydrofoil, seeks and maintains said submerged position, while controlling said height of said hull above the body of water.

2. Apparatus and function as defined in claim 1 wherein:

(a) said strut means comprising two struts spaced apart from each other, (b) said main hydrofoil comprising a hydrofoil with dihedral of at least zero degrees, said main hydrofoil extending in span to at least said struts, said struts projecting from said hull attachment means and being joined by said foil attachment means to said main hydrofoil placing said main hydrofoil in a submerged position within said body of water, (c) said hull attachment means including said pivot means constructed and arranged to provide pivotal attachment between said hull and said struts, said pivot means having an axis, said axis being oriented such that when said struts rotate about said axis, a change in said main hydrofoil's angle of attack is effected, (d) said connecting means comprising structural supports, one of said structural supports being rigidly attached to each strut, each said structural support projecting from each said strut providing a mounting surface, one said control hydrofoil being attached to each mounting surface at a predetermined angle of incidence.

3. Apparatus and function as defined in claim 2 wherein:

(a) said hull attachment means including a resilient means, said resilient means constructed and arranged to apply a predetermined variation of moments to said struts about said axis forcing said control hydrofoil and said main hydrofoil in a direction to decrease said angle of attack.

4. Apparatus and function as defined in claim 2 wherein:

(a) said control hydrofoil predetermined angle of incidence being zero degrees or less.

5. Apparatus and function as defined in claim 1 wherein:

(a) said strut means comprising a single strut, (b) said foil attachment means providing attachment of said main hydrofoil to said single strut, said single strut projecting from said hull attachment means and placing said main hydrofoil in a submerged position within said body of water, (c) said hull attachment means including said pivot means constructed and arranged to provide pivotal attachment between said hull and said single strut, said pivot means having a first axis, said first axis being oriented such that when said single strut rotates about said first axis, a change in said main hydrofoil's angle of attack is effected, (d) said connecting means comprising a structural support, said structural support being rigidly attached to said strut and projecting from said strut providing a mounting surface, said control hydrofoil being attached to said mounting surface at a predetermined angle of incidence.

6. Apparatus and function as defined in claim 5 wherein:

(a) said hull attachment means including a resilient means, said resilient means constructed and arranged to apply a predetermined variation of moments to said single strut about said first axis forcing said control hydrofoil and said main hydrofoil in a direction to decrease said angle of attack.

7. Apparatus and function as defined in claim 5 wherein:

(a) said control hydrofoil predetermined angle of incidence being zero degrees or less.

8. Apparatus and function as defined in claim 5 wherein:

(a) said hull attachment means including a second pivot means, said second pivot means constructed and arranged to provide pivotal attachment between said hull and said single strut, said second pivot means having a second axis, said second axis being oriented to a generally vertical direction, (b) whereby said single strut is enabled to perform as a rudder without significant effect on the function of said control and main hydrofoils.

9. Apparatus and function as defined in claim 8 wherein:

(a) said hull attachment means including a resilient means, said resilient means constructed and arranged to apply a predetermined variation of moments to said single strut about said first axis forcing said control hydrofoil and said main hydrofoil in a direction to decrease said angle of attack.

10. Apparatus and function as defined in claim 8 wherein:

(a) said control hydrofoil predetermined angle of incidence being zero degrees or less.

11. Apparatus and function as defined in claim 8 wherein:

(a) there being two of said apparatus, a first apparatus spaced apart in a beamwise direction from a second apparatus, (b) said apparatuses being connected by an interconnecting means, said interconnecting means being constructed and arranged such that rotations of said first apparatus and said second apparatus about each respective said first axis are in opposite directions causing opposite changes of angles of attack in said main hydrofoils, (c) said apparatuses being connected by a second interconnecting means, said second interconnecting means being constructed and arranged such that rotations of said first apparatus and said second apparatus about each respective said second axis are in the same direction such that said apparatuses are enabled to be operated cooperatively as rudders, (d) whereby the interconnected apparatuses operate cooperatively and provide automatic heel control, manual rudder control and assist in pitch stabilization.

12. Apparatus and function as defined in claim 5 wherein:

(a) there being two of said apparatus, a first apparatus spaced apart in a beamwise direction from a second apparatus, (b) said apparatuses being connected by an interconnecting means, said interconnecting means being constructed and arranged such that rotations of said first apparatus and said second apparatus about each respective said first axis are in opposite directions causing opposite changes of angles of attack in said main hydrofoils, (c) whereby the interconnected apparatuses operate cooperatively and provide automatic heel control and assist in pitch stabilization.

13. Apparatus and function as defined in claim 1 wherein:

(a) said control hydrofoil being submerged within three control hydrofoil chord lengths below the water surface and such that no part of said control hydrofoil penetrates the water surface whereby at least a portion of said control hydrofoil's moment balancing load capability is influenced by the depth of submergence of said control hydrofoil.

* * * * *